US008579451B2

(12) United States Patent
Galvez et al.

(10) Patent No.: US 8,579,451 B2
(45) Date of Patent: Nov. 12, 2013

(54) LED LAMP

(75) Inventors: Miguel Galvez, Danvers, MA (US); Kenneth Grossman, Beverly, MA (US); David Betts, Peabody, MA (US)

(73) Assignee: Osram Sylvania Inc., Danvers, MA (US)

( * ) Notice: Subject to any disclaimer, the term of this patent is extended or adjusted under 35 U.S.C. 154(b) by 286 days.

(21) Appl. No.: 13/233,592

(22) Filed: Sep. 15, 2011

(65) Prior Publication Data

US 2013/0070448 A1 Mar. 21, 2013

(51) Int. Cl.
*F21V 33/00* (2006.01)

(52) U.S. Cl.
USPC ..... 362/84; 362/311.02

(58) Field of Classification Search
USPC ..... 362/84, 311, 97.3
See application file for complete search history.

(56) References Cited

U.S. PATENT DOCUMENTS

| | | | | |
|---|---|---|---|---|
| 6,577,073 | B2 | 6/2003 | Shimizu et al. | |
| 6,692,136 | B2 | 2/2004 | Marshall et al. | |
| 6,812,500 | B2 | 11/2004 | Reeh et al. | |
| 7,183,706 | B2 | 2/2007 | Ellens et al. | |
| 7,344,902 | B2 * | 3/2008 | Basin et al. | 438/27 |
| 7,344,952 | B2 | 3/2008 | Chandra | |
| 7,479,662 | B2 | 1/2009 | Soules et al. | |
| 7,488,088 | B2 | 2/2009 | Brukilacchio | |
| 7,510,888 | B2 | 3/2009 | Guenther et al. | |
| 7,540,616 | B2 | 6/2009 | Conner | |
| 7,618,157 | B1 | 11/2009 | Galvez et al. | |
| 7,703,945 | B2 | 4/2010 | Leung et al. | |
| 7,810,956 | B2 | 10/2010 | Bierhuizen et al. | |
| 7,859,190 | B2 | 12/2010 | Shi | |
| 7,883,226 | B2 | 2/2011 | Li | |
| 2009/0147497 | A1 * | 6/2009 | Nada | 362/84 |
| 2010/0025700 | A1 | 2/2010 | Jung et al. | |
| 2010/0123855 | A1 * | 5/2010 | Shin | 349/61 |
| 2010/0232134 | A1 | 9/2010 | Tran | |
| 2011/0031516 | A1 | 2/2011 | Basin | |

FOREIGN PATENT DOCUMENTS

| | | |
|---|---|---|
| EP | 2 348 244 | 7/2011 |
| WO | WO 2008/142638 | 11/2008 |
| WO | WO 2009/093163 | 7/2009 |
| WO | WO 2011/109097 | 9/2011 |
| WO | WO 2011/149737 A1 | 12/2011 |

* cited by examiner

*Primary Examiner* — Laura Tso
(74) *Attorney, Agent, or Firm* — Robert F. Clark

(57) ABSTRACT

There is herein described a lamp for providing white light comprising a plurality of light sources positioned on a substrate. Each of said light sources comprises a blue light emitting diode (LED) and a dome that substantially covers said LED. A first portion of said blue light from said LEDs is transmitted through said domes and a second portion of said blue light is converted into a red light by a first phosphor contained in said domes. A cover is disposed over all of said light sources that transmits at least a portion of said red and blue light emitted by said light sources. The cover contains a second phosphor that emits a yellow light in response to said blue light. The red, blue and yellow light combining to form the white light and the white light having a color rendering index (CRI) of at least about 80.

4 Claims, 2 Drawing Sheets

LED LAMP

GOVERNMENT CONTRACT

This invention was made with government support under Cooperative Agreement No. DE-EE0003241 awarded by the U.S. Department of Energy. The government has certain rights in the invention.

TECHNICAL FIELD

This invention relates to light sources and more particularly to areal light sources; that is, light sources that are more commonly employed for general room illumination, as opposed to light sources employed for task lighting.

BACKGROUND OF THE INVENTION

An increasing number of lighting solutions have been proposed to replace the ubiquitous linear fluorescent lamps used in 2'×2' and 2'×4' ceiling fixtures. Among the lamps being suggested to replace fluorescent lamps are elongated tubes containing various linearly distributed combinations of light emitting diodes (LED or LEDs). Other lamps include one or more two-dimensional spatial arrays of LEDs distributed throughout a rectangular fixture.

One particular arrangement of LEDs that has been used for general illumination is a plurality of spaced red- and white-light emitting LEDs. The blended light from all of the LEDs produces a quantity of white light with a higher color rendering index (CRI) due to the influence of the red-emitting LEDs. However, it is desirable for ceiling mounted fixtures to produce and evenly distributed diffuse light which is difficult to achieve with individually mounted LEDs alone.

Another approach is to use a linear arrangement or array of blue-emitting LEDs and a remote phosphor converter spaced at a distance from the LEDs which covers all of the LEDs, such as described in U.S. Pat. No. 7,618,157. The remote phosphor converter comprises a plastic material that has been embedded with a phosphor, in particular a yellow-emitting YAG:Ce phosphor. The blue light from the LED impinges upon remote converter which then coverts at least a portion of the blue light into light having a longer wavelength such as yellow. The combined effect is to produce a diffuse white light. In order to modify the spectrum to generate a higher CRI, a red-emitting phosphor can be mixed with the yellowing-emitting phosphor in the remote converter. However, because the remote converter covers the entire array, a much larger amount of phosphor must be used in comparison to using individual white-emitting LEDs. While this is less of a issue when using relatively inexpensive phosphors, red-emitting phosphors tend to be much more costly thereby making this approach less attractive for producing high CRI sources for areal lighting.

SUMMARY OF THE INVENTION

It is, therefore, an object of the invention to enhance LED light sources for areal lighting.

Yet another object of the invention is the improvement of LED lamps using remote phosphor conversion.

Yet another object of the invention is to provide a diffuse white light source having a high color rendering.

These objects are accomplished, in one aspect of the invention, by the provision of a lamp for providing white light comprising a plurality of light sources positioned on a substrate. Each of said light sources comprises a light emitting diode (LED) and a dome that substantially covers said LED. Said LEDs emit a blue light in a wavelength range of about 420 nm to about 490 nm. Said domes contain a first phosphor that emits a red light in a wavelength range of about 600 nm to about 710 nm in response to said blue light. A first portion of said blue light from said LEDs is transmitted through said domes and a second portion of said blue light is converted into said red light. A cover is disposed over all of said light sources that transmits at least a portion of said red and blue light emitted by said light sources. The cover contains a second phosphor that emits a yellow light in a wavelength range of about 550 nm to about 590 nm in response to said blue light. The red, blue and yellow light combining to form the white light and the white light having a color rendering index (CRI) of at least about 80.

The lamps thus produced are well suited for, among other things, aereal room lighting. The lamps can be made to have a substantially uniform white appearance when energized and the cost of the lamp is reduced through the efficient utilization of the various phosphors.

DETAILED OF THE INVENTION

Figure 1:
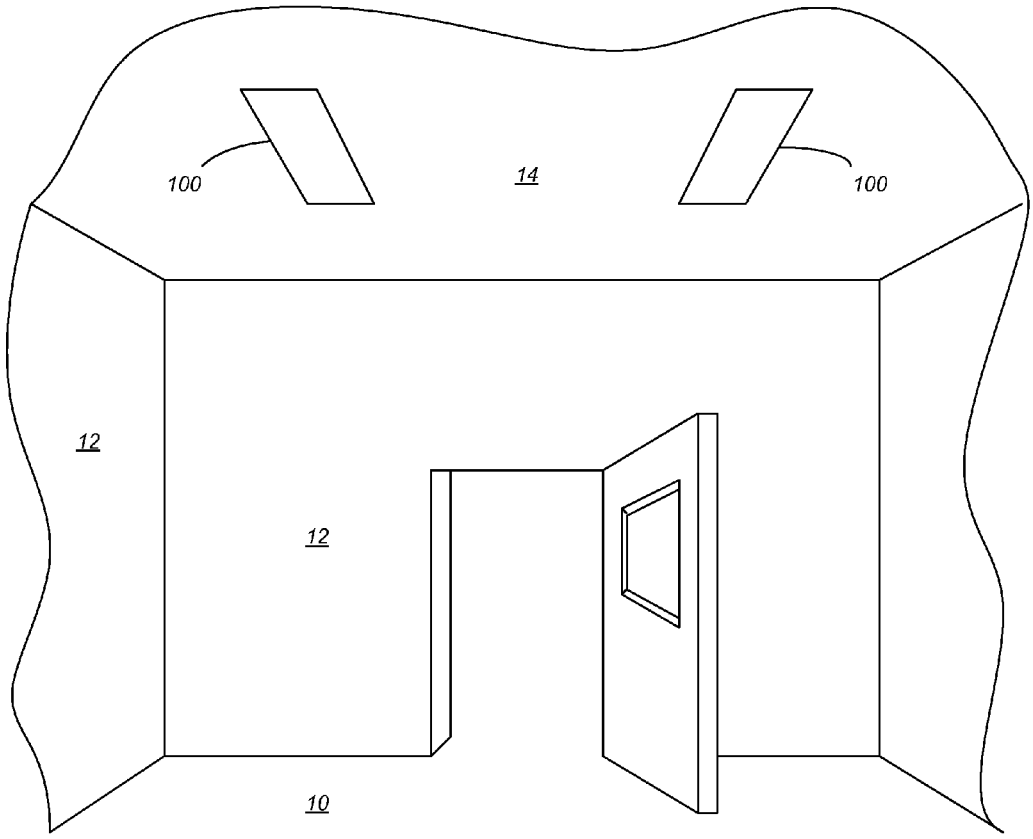
FIG. 1 is a perspective view of an environmental location for the invention.

For purposes of this application it is to be understood that when an element or layer is referred to as being "on," "connected to" or "coupled to" another element or layer, it can be directly on, connected to or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. The term "and/or" includes any and all combinations of one or more of the associated listed items.

Although the terms "first," "second," "third" etc. may be used to describe various elements, components, regions, layers and/or sections, these elements, components, regions, layers and/or sections are not to be limited by theses terms as they are used only to distinguish one element, component, region, layer or section from another element, component, region, layer or section. Thus, a first element, component, region, layer or section could be termed a second element, component, region, layer or section without departing from the scope and teachings of the present invention.

Spatially relative terms, such as "beneath," "below," "upper," "lower," "above" and the like may be used herein for ease of description to describe one element or feature's relationship to another element(s) or feature(s) as illustrated in the drawings. These spatially relative terms are intended to encompass different orientations of the device in use or operation in addition to the orientation shown in the drawings. For example, if the device in the drawings is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. For example, as used herein, the singular forms "a," "an" and "the" are intended to include the plural forms as well, unless the context clearly indicates otherwise. It will be further understood that the terms, "comprises" and/or "comprising," when used in this specification, specify the presence of stated features, integers, steps operations, elements, and/or components, but do not preclude the presence or addition of one or more other features, integers, steps, operations, elements, components, and/or groups thereof.

For a better understanding of the present invention, together with other and further objects, advantages and capabilities thereof, reference is made to the following disclosure and appended claims taken in conjunction with the above-described drawings.

Referring now to the drawings with greater particularity there is shown in FIG. 1 a typical room 10 including walls 12 and ceiling 14. At least one lamp 100 is positioned in the ceiling 14 in a suitable fixture. The lamp 100 (see FIG. 2) provides substantially uniform white light and in a preferred embodiment comprises a substrate 120 in the form of a printed circuit board having a plurality of light sources 110 positioned thereon. Preferably the light sources are arranged in an $n_1 \times n_2$ array wherein $n_1 \geq n_2$. The substrate 120 is mounted upon a heat sink 200 to remove any excess heat generated by the light sources 110 when they are operating. Each of the light sources 110 comprises a light emitting diode (LED) 140 and a dome 160. The LEDs 140 emit a blue light in a wavelength range of about 420 nm to about 490 nm and may be in the form of a package or die mounted to substrate 120.

Figure 2:
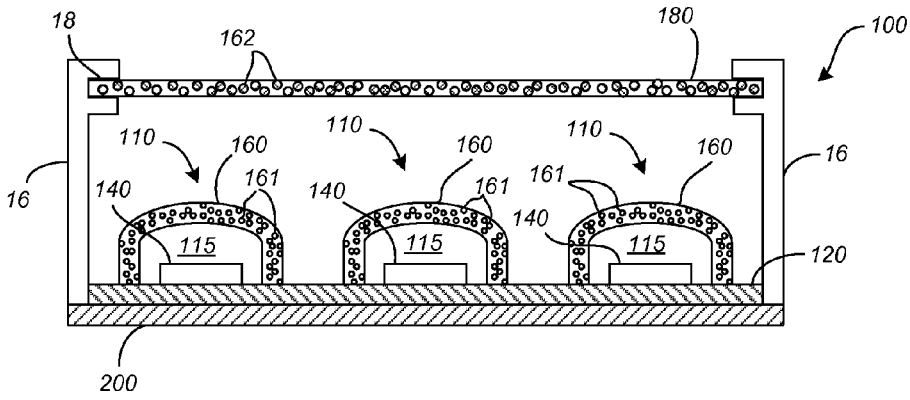
FIG. 2 is an elevational view in cross-section illustrating an embodiment of the invention.

Each dome 160 covers a respective one of the LEDs 140 and contains a first phosphor 161 that emits a red light in response to excitation by the blue light emitted by the LEDs 140. The domes 160 are preferably constructed from a translucent material such as silicone, polypropylene, PMMA, polycarbonates, ceramic or various glasses (with PMMA and silicone being preferred). The domes may be hollow as shown in FIG. 2 or they may be substantially solid. In the case that the dome 160 is hollow, it may be preferred to fill the interior 115 with a transparent silicone resin so as to provide better optical coupling between the LED and the dome. The embedded first phosphor 161 preferably emits red light in a wavelength range of about 600 nm to about 710 nm, and more preferably about 600 nm to about 650 nm. A preferred red-emitting phosphor is $(Sr,Ca)_2Si_5N_8$:Eu. The domes 160 convert only a portion of the blue light emitted by the LEDs 140 in red light and transmit the remainder. Thus, each of the light sources 110 emit a combination of red and blue light wherein the relative proportion of red and blue light from a light source 110 is determined by (1) how much blue light emitted by its LED 140 is converted into red light by its respective dome 160 and (2) how much blue light is transmitted through said same dome.

A cover 180 is positioned over all of the light sources 140 and is held in place in any convenient manner. As shown in exemplary fashion in FIG. 2, vertical supports 16 extend from the substrate 120 and terminate in a groove 18 that mounts the cover 180. The cover 180 (which also is at least translucent) transmits at least some of the radiation emitted by the light sources 110 and contains a second phosphor 162 that emits a yellow light in a wavelength range of about 550 nm to about 590 nm in response to the blue light from light sources 110. A preferred yellow-emitting phosphor is $Y_3Al_5O_{12}$:Ce (YAG:Ce). The cover material can be similar to the dome material.

The color choices of the phosphors (color, in this instance referring to the color of the light emitted by the phosphors upon suitable excitation and not the body color of the materials) are selected to provide a white light with a CRI of at least about 80, and more preferably at least about 85.

As a comparative example, a similar lamp was constructed but without the domes over each LED. Instead, a few of the blue-emitting InGaN LEDs were replaced with red-emitting InGaAlP LEDs to compensate for the loss of the red emission that would have been generated by the phosphor-containing domes. As shown in the Table I below, similar x,y color coordinates and CRI values were obtained for both lamps. However, the appearance of comparative lamp was dramatically different. In particular, the cover of the comparative lamp had visible reddish "hot spots" caused by the highly directional emission from the red-emitting LEDs whereas the cover of the inventive lamp appeared substantially uniformly white when the lamp was energized. This demonstrates that the more diffuse emission of the red light from the phosphor-containing domes covering the LEDs in the inventive lamp is producing a more uniform appearance for the lamp while achieving a similar light quality.

TABLE I

| LAMP TYPE | Cx | Cy | CRI |
|---|---|---|---|
| COMPARATIVE LAMP | 0.391 | 0.383 | 92 |
| INVENTIVE LAMP | 0.388 | 0.387 | 87 |

Figure 3:
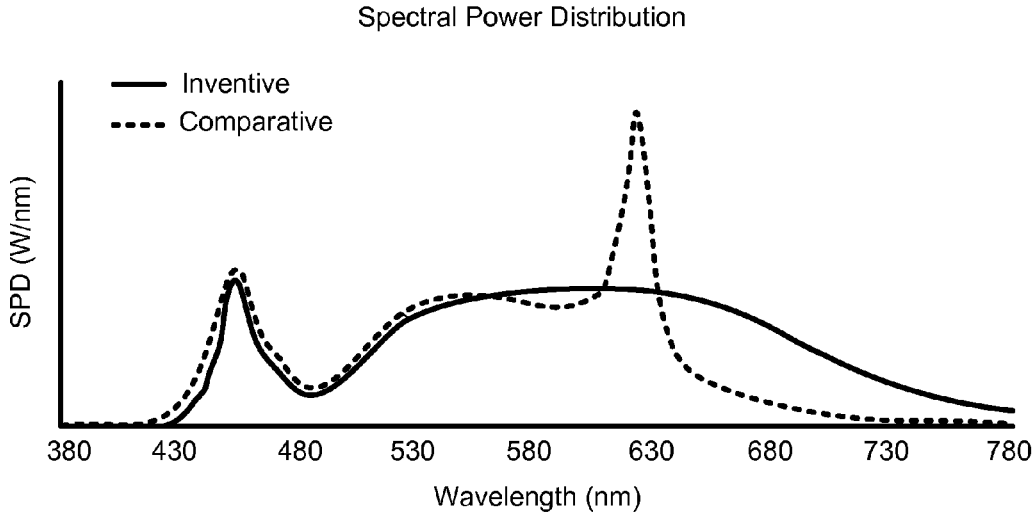
FIG. 3 is a graph of the spectral power distribution of an embodiment of the invention compared with a similarly constructed lamp using red-emitting LEDs.

The effect of red "hot spots" generated by the comparative lamp are further evident by comparing the spectral power distributions (SPD) of the two lamps as shown in FIG. 3. For the most part, the two SPD curves are similar except that in the red region above about 600 nm, the SPD of the comparative lamp exhibits a sharp spike at about 630 nm whereas the SPD of the inventive lamp is a broad continuum which is more preferred from a color rendering aspect.

In the development of the lamp 100 an important consideration is the cost of the phosphors involved, which can vary considerably. For example, the red emitting phosphor is generally much more expensive than the other phosphors and thus to make a cost-effective lamp its use must be controlled. This is accomplished in the instant invention by incorporating the red (more costly phosphor) into the dome 160 and keeping it in closer relation to the blue source while allowing the less costly phosphors materials to be used in the remotely deployed cover 180.

Lamp 100 thus provides a substantially even white light without the notable hot spots that would occur if red-emitting LEDs were employed and further provides a lamp with a high CRI while using less of the costly red-emitting phosphors.

While there have been shown and described what are at present considered to be the preferred embodiments of the invention, it will be apparent to those skilled in the art that various changes and modifications can be made herein without departing from the scope of the invention as defined by the appended claims.

The invention claimed is:

1. A lamp for providing white light, the lamp comprising:

a plurality of light sources positioned on a substrate, each of said light sources comprising a light emitting diode (LED) and a dome that substantially covers said LED;

said LEDs emitting a blue light in a wavelength range of about 420 nm to about 490 nm and said domes containing a first phosphor that emits a red light in a wavelength range of about 600 nm to about 710 nm in response to said blue light, a first portion of said blue light from said LEDs being transmitted through said domes and a second portion of said blue light being converted into said red light; and a cover disposed over all of said light sources, said cover transmitting at least a portion of said red and blue light emitted by said light sources and containing a second phosphor that emits a yellow light in a wavelength range of about 550 nm to about 590 nm in response to said blue light, and said red, blue and yellow light combining to form said white light, said white light having a color rendering index (CRI) of at least about 80.

2. The lamp of claim 1 wherein said white light has a CRI of at least about 85.

3. The lamp of claim 1 wherein said second phosphor is $Y_3Al_5O_{12}$:Ce.

4. The lamp of claim 3 wherein said first phosphor is $(Sr,Ca)_2Si_5N_8$:Eu.

* * * * *